US010503100B2

(12) United States Patent
Toda

(10) Patent No.: US 10,503,100 B2
(45) Date of Patent: Dec. 10, 2019

(54) POWDER SUPPLY DEVICE

(71) Applicant: KONICA MINOLTA, INC., Tokyo (JP)

(72) Inventor: Toru Toda, Hyogo (JP)

(73) Assignee: KONICA MINOLTA, INC., Tokyo (JP)

( * ) Notice: Subject to any disclaimer, the term of this patent is extended or adjusted under 35 U.S.C. 154(b) by 87 days.

(21) Appl. No.: 15/845,024

(22) Filed: Dec. 18, 2017

(65) Prior Publication Data

US 2018/0173135 A1 Jun. 21, 2018

(30) Foreign Application Priority Data

Dec. 19, 2016 (JP) ..... 2016-245326

(51) Int. Cl.

| | |
|---|---|
| ***B65B 1/16*** | (2006.01) |
| ***G03G 15/08*** | (2006.01) |
| ***B65B 39/00*** | (2006.01) |
| ***B65B 1/34*** | (2006.01) |

(52) U.S. Cl.

CPC ..... *G03G 15/0894* (2013.01); *B65B 1/16* (2013.01); *B65B 1/34* (2013.01); *B65B 39/007* (2013.01)

(58) Field of Classification Search

CPC .. G03G 15/0894; G03G 15/0877; B65B 1/34; B65B 1/16; B65B 39/007

USPC ..... 141/70

See application file for complete search history.

(56) References Cited

U.S. PATENT DOCUMENTS 5,727,607 A * 3/1998 Ichikawa ..... B65B 1/16 141/374
2007/0157990 A1* 7/2007 Amano ..... B65B 1/16 141/83

FOREIGN PATENT DOCUMENTS

JP 2005-075376 A 3/2005
JP 2016172566 A 9/2016

OTHER PUBLICATIONS

Extended European Search Report dated Mar. 7, 2018 from the corresponding European Patent Application No. 17207950.1.

* cited by examiner

*Primary Examiner* — Marina A Tietjen
*Assistant Examiner* — Paul J Gray
(74) *Attorney, Agent, or Firm* — Lucas & Mercanti, LLP

(57) ABSTRACT

A powder supply device including: a powder fluidizing unit which blows air into the powder in the tank to fluidize the powder; a powder supply path forming member which forms a powder supply path in which one end is the ejection port and the other end is an inflow port connected to the tank, wherein the fluidized powder flows into the inflow port so as to be ejected from the ejection port through the powder supply path; an air blower which blows air toward the powder that is about to flow into the inflow port; and a hardware processor, wherein the hardware processor is capable of executing supply flow rate control of controlling a powder ejection amount from the ejection port according to an air blowing amount by the air blower by controlling the air blowing amount.

8 Claims, 5 Drawing Sheets

POWDER SUPPLY DEVICE

CROSS-REFERENCE TO RELATED APPLICATIONS

Japanese Patent Application No. 2016-245326 filed on Dec. 19, 2016, including description, claims, drawings, and abstract of the entire disclosure is incorporated herein by reference in its entirety.

BACKGROUND

1. Technological Field

The present invention relates to a powder supply device which controls the flow rate of a powder to supply the powder.

2. Description of the Related Art

There have been conventionally used powder supply devices which supply predetermined amounts of powders such as toners to the supply destinations such as containers Japanese Patent Application Laid-Open Publication No. 2016-172566 describes a toner filling apparatus which executes toner draw-in filling control for the purpose of improving the filling speed and the filling density while maintaining the toner properties, the toner draw-in filling control being control in which when a control unit fluidizes a toner in a filling tank by a toner fluidizing unit and opens a toner filling path by a filling path opening/closing unit so as to load the fluidized toner from the filling tank to a toner container, the control unit reduces a pressure in the toner container to a negative pressure by a container room sucking unit so as to draw in the toner from the filling tank into the toner container by the negative pressure.

Japanese Patent Application Laid-Open Publication No. 2016-172566 also describes regulating a powder flow path cross-sectional area to a comparatively small size, opening the powder filling path by the filling path opening/closing unit so as to fill the powder container with the powder through the powder filling path until a measured value by a measuring unit reaches a target value.

Japanese Patent Application Laid-Open Publication No. 2016-172566 also describes closing the powder filling path by sucking air from a mixture of the powder and air in the powder supply path through a filter member to temporarily aggregate the residual powder, in which the filter member is impermeable to the powder but permeable to air.

SUMMARY

However, in the invention described in Japanese Patent Application Laid-Open Publication No. 2016-172566, the accuracy and speed of the supply amount are contrary to each other depending on the powder flow path cross-sectional area since the powder flow path cross-sectional area is regulated to a small size in order to accurately supply the powder amount of the target value easily.

The present invention has been made in consideration of the above problems in the conventional techniques, and an object of the present invention is to accurately control the supplied powder flow rate without depending on the powder flow path cross-sectional area in the powder supply device which controls the powder flow rate to supply the powder.

To achieve at least one of the abovementioned objects, according to an aspect of the present invention, a powder supply device reflecting one aspect of the present invention ejects a powder stored in a tank from a predetermined ejection port to supply the powder, the powder supply device including: a powder fluidizing unit which blows air into the powder in the tank to fluidize the powder; a powder supply path forming member which forms a powder supply path in which one end is the ejection port and the other end is an inflow port connected to the tank, wherein the powder in the tank which is fluidized by the powder fluidizing unit flows into the inflow port so as to be ejected from the ejection port through the powder supply path; an air blower which blows air toward the powder that is about to flow into the inflow port; and a hardware processor, wherein the hardware processor is capable of executing supply flow rate control of controlling a powder ejection amount from the ejection port according to an air blowing amount by the air blower by controlling the air blowing amount.

BRIEF DESCRIPTION OF THE DRAWINGS

The advantages and features provided by one or more embodiments of the invention will become more fully understood from the detailed description given hereinafter and the appended drawings which are given by way of illustration only, and thus are not intended as a definition of the limits of the present invention, and wherein.

DETAILED DESCRIPTION OF EMBODIMENTS

Hereinafter, one or more embodiments of the present invention will be described with reference to the drawings. However, the scope of the invention is not limited to the disclosed embodiments.

[First Embodiment]

First, a powder supply device in a first embodiment of the present invention will be described.

Figure 1:
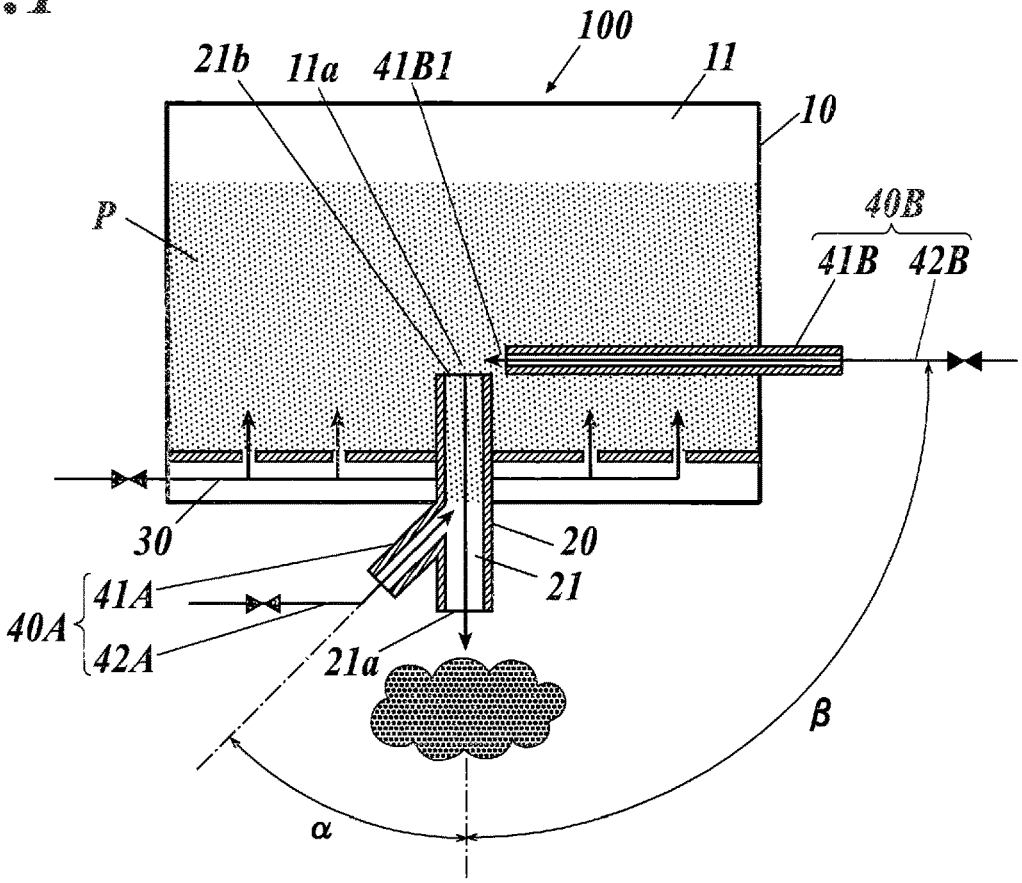
FIG. 1 is a front schematic view of a powder supply device in a first embodiment of the present invention.
Figure 2:
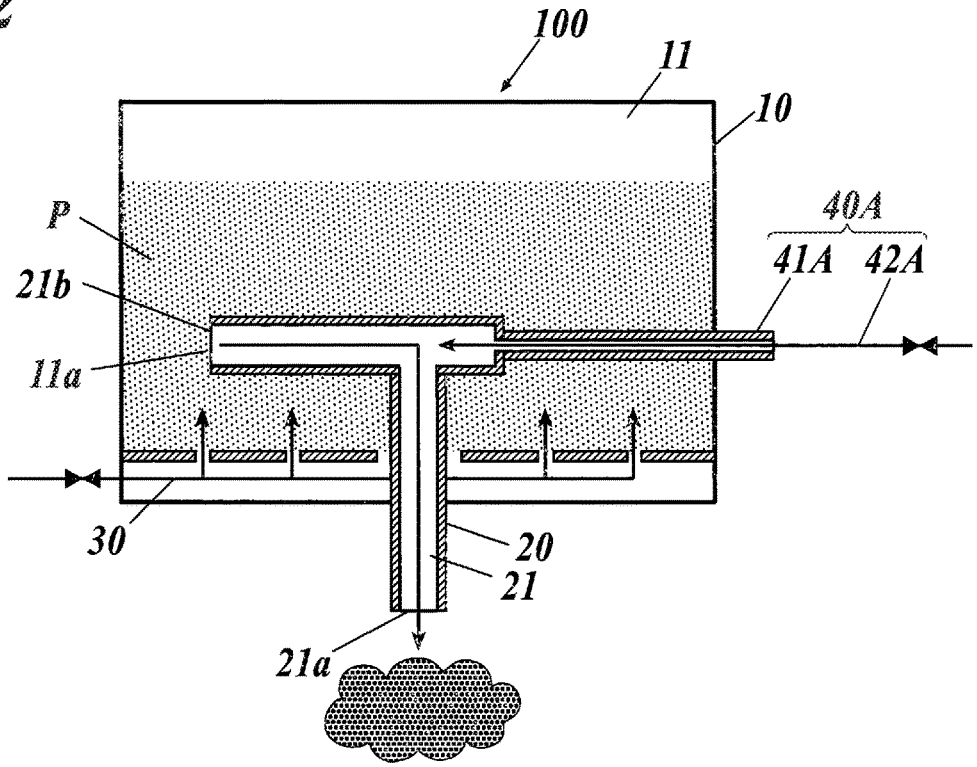
FIG. 2 is a front schematic view of a powder supply device in the first embodiment of the present invention, showing a modification example of FIG. 1.
Figure 3:
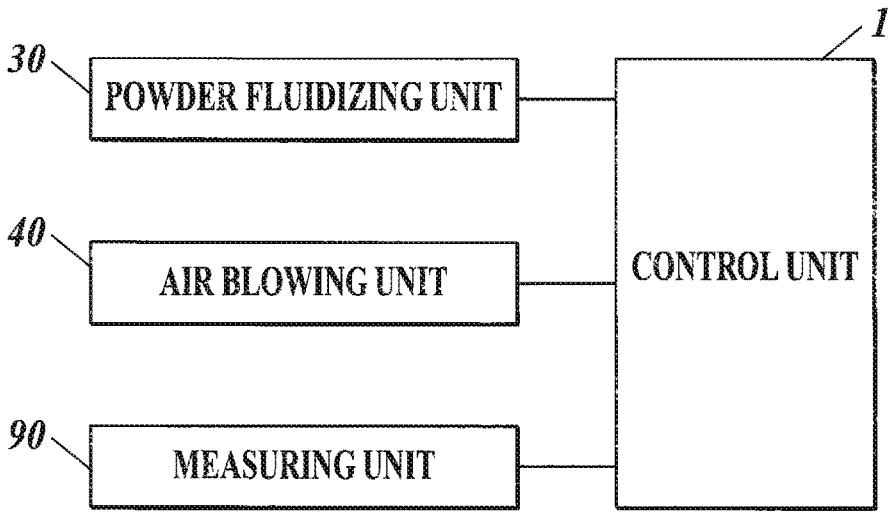
FIG. 3 is a block diagram of a control system of the powder supply device in the first embodiment of the present invention.

As shown in FIGS. 1, 2 and 3, a powder supply device 100 in the embodiment includes a tank 10, a powder supply path forming member 20, a powder fluidizing unit 30, an air blowing unit 40 and a control unit 1. The block diagram of the control system of the powder supply device 100 in the embodiment is shown in FIG. 3.

The powder P which is a supply target is stored in the tank 10. The powder P is a toner, for example. Though not shown in the drawings, the powder P is replenished to a powder storing space 11 of the tank 10 through a supply port that is disposed in a lateral portion or the like of the tank 10.

The powder supply path forming member 20 is a cylindrical body which is provided in the lower end of the tank 10. The powder supply path forming member 20 forms a powder supply path 21 in which one end is an ejection port 21*a* and the other end is an inflow port 21*b* that is connected to the powder storing space 11.

The powder supply path forming member 20 can have a configuration in which the inflow port 21*b* is disposed upward in a vertical direction as shown in FIG. 1, a configuration in which the inflow port 21*b* is disposed horizontally as shown in FIG. 2, and such like. Though a general configuration disposes the ejection port 21*a* downward in the vertical direction, the ejection port 21*a* may be disposed in an appropriate direction according to the convenience of the receiving side of the supply. Accordingly, there is used a straight powder supply path forming member 20 as shown in FIG. 1, an L-shaped powder supply path forming member 20 as shown in FIG. 2, or the like as needed.

The powder fluidizing unit 30 includes a filter member that is disposed on a wall defining the powder storing space 11, an air supply path for blowing air to the powder P in the tank 10 through the filter member so as to fluidize the powder P, a control valve and such like. The filter member is impermeable to the powder P but permeable to air, which is made of a porous material or the like.

The powder supply device 100 causes the powder P in the tank 10 fluidized by the powder fluidizing unit 30 to flow into the inflow port 21*b* and ejects the powder P from the ejection port 21*a* through the powder supply path 21 to supply the powder P.

The air blowing unit 40 (40A, 40B) is configured by including an air blowing tube 41 (41A, 41B), an air supply path for blowing air toward the powder flowing into the inflow port 21*b* through the air blowing tube 41 (41A, 41B), a control valve 42 (42A, 42B) and such like.

One or both of the first type of air blowing unit 40A and the second type of air blowing unit 40B are used.

In the first type of air blowing unit 40A, the air blowing tube 41A is connected to the powder supply path 21, air reaches the inflow port 21*b* through a part of the powder supply path 21 including the inflow port 21*b*, and the air further reaches the immediate anterior region 11*a* to the inflow port 21*b* in the powder storing space 11. That is, the powder supply path 21 is used as an air path to the inflow port 21*b*. Accordingly, in a case of the first type of air blowing unit 40A, air is blown from inside the powder supply path 21 to the inflow port 21*b* and further to the immediate anterior region 11*a*.

By such a configuration, air is blown toward the powder P which is about to flow into the inflow port 21*b*. As the air blowing amount increases, the inflow amount of the powder P to the inflow port 21*b*, that is, the powder ejection amount from the ejection port 21*a* is suppressed. That is, the air blown from the air blowing tube 41A is a resistance to the powder P which is about to flow into the inflow port 21*b*.

The connection angle α of the air blowing tube 41A with respect to the axis direction of the inflow port 21*b* is arbitrary and sufficient as long as the powder ejection amount is suppressed. In the embodiment, the air blowing unit 40A has a capacity capable of blowing an air blowing amount which makes the powder ejection amount from the ejection port 21*a* be zero.

In the configuration shown in FIG. 2, the connection angle α of the air blowing tube 41A with respect to the axis direction of the inflow port 21*b* is 180 degrees. In the configuration shown in FIG. 2, the powder supply path 21 is a horizontal path from the inflow port 21*b* to a predetermined dimension.

The second type of air blowing unit 40B does not use the powder supply path 21 as an air path to the inflow port 21*b*, and a blowing port 41B1 of the air blowing tube 41B is disposed in the powder storing space 11. In this case, the blowing port 41B1 is directed toward the immediate anterior region 11*a*, and an appropriate nozzle shape is applied.

By such a configuration, air is blown toward the powder P which is about to flow into the inflow port 21*b*. As the air blowing amount increases, the inflow amount of the powder P to the inflow port 21*b*, that is, the powder ejection amount from the ejection port 21*a* is suppressed. That is, the air blown from the air blowing tube 41B is a resistance to the powder P which is about to flow into the inflow port 21*b*.

The blowing angle β with respect to the axis direction of the inflow port 21*b* is arbitrary and sufficient as long as the powder ejection amount is suppressed. In the embodiment, the air blowing unit 40B has a capacity capable of blowing an air blowing amount which makes the powder ejection amount from the ejection port 21*a* be zero.

The air blown into the powder storing space 11 from the inflow port 21*b* also has an action of fluidizing the powder P, and the air blowing unit 40 is also a powder fluidizing unit. Accordingly, there can be an embodiment of using only the air blowing unit 40 as the powder fluidizing unit.

The control unit 1 controls the powder fluidizing unit 30, the air blowing unit 40 and such like. As the control unit 1, a computer provided with a processor, a storage device and such like is used. The processor executes a program stored in the storage device, and thereby achieves a function of executing after-mentioned control contents of powder supply. The control unit 1 is capable of setting a target value of the supply amount of the powder P.

The control contents of powder supply in the powder supply device 100 in the embodiment will be described later.

[Second Embodiment]

Next, a powder supply device in a second embodiment of the present invention will be described. As shown in FIGS. 4, 5, 6 and 7, a powder supply device 101 in the embodiment has a configuration similar to that of the powder supply device 100 in the first embodiment except that a supply path opening/closing unit 50 is further added to the configuration of the first embodiment. The block diagram of the control system of the powder supply device 101 in the embodiment is shown in FIG. 7.

The supply path opening/closing unit 50 (50A, 50B) in the second embodiment of the present invention is configured by including a filter member 51 (51A, 51B), an air intake path, a control valve 52 (52A, 52B) and an air intake tube 53 (53A, 53B).

The filter member 51 is impermeable to the powder P but permeable to air, which is made of a porous material or the like.

The supply path opening/closing unit 50 closes the powder filling path 21 by sucking air from a mixture of the powder P and air in the powder supply path 21 through a filter member 51 to temporarily aggregate the residual powder. The aggregated powder JP (JP1, JP2) is shown in the drawings. Thereafter, the supply path opening/closing unit 50 opens the powder supply path 21 by stopping the suction. By controlling the suction force, it is possible to control the size of the aggregated powder JP, that is, the opening degree of the powder supply path 21.

The first type of supply path opening/closing unit 50A is provided so as to make the aggregated powder JP1 on a side closer to the ejection port 21*a* than a junction 21*c* of the powder supply path 21 and the air flow path by the air blowing unit 40A. An air intake tube 53A is connected to the powder supply path forming member 20.

The second type of supply path opening/closing unit 50B is provided so as to make the aggregated powder JP2 on a side closer to the inflow port 21*b* than the junction 21*c*, and an air intake tube 53B is connected to the powder supply path forming member 20. One or both of the first type of supply path opening/closing unit 50A and the second type of supply path opening/closing unit 50B are used.

Figure 5:
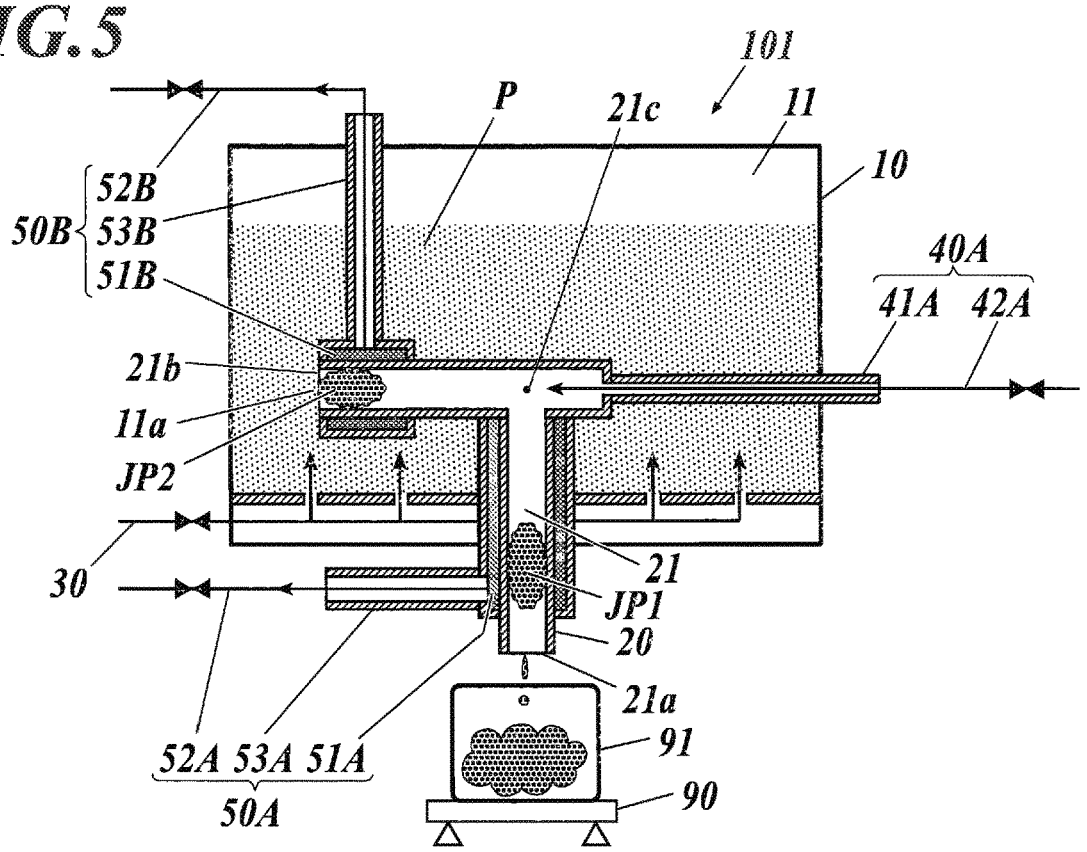
FIG. 5 is a front schematic view of a powder supply device in the second embodiment of the present invention, adding a measuring unit to FIG. 4.

FIG. 5 shows the second embodiment of the present invention in which a measuring unit 90 is used. As the measuring unit 90, a digital scale is used. The measuring unit 90 measures the weight of the container 91 and the weight of the powder in the container 91. The measuring unit 90 measures the powder ejected from the ejection port 21*a*, and inputs the measurement value to the control unit 1. The measuring unit 90 may be also used as needed in the first and third embodiments.

Figure 4:
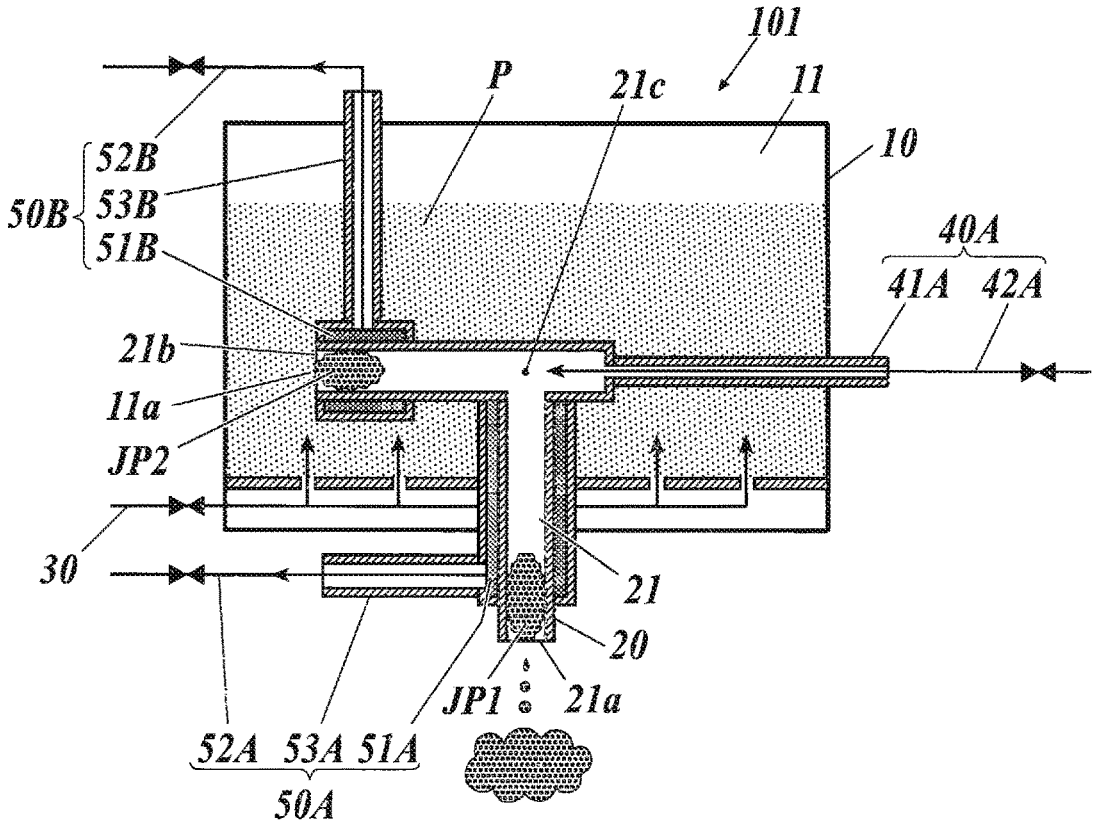
FIG. 4 is a front schematic view of a powder supply device in a second embodiment of the present invention.
Figure 6:
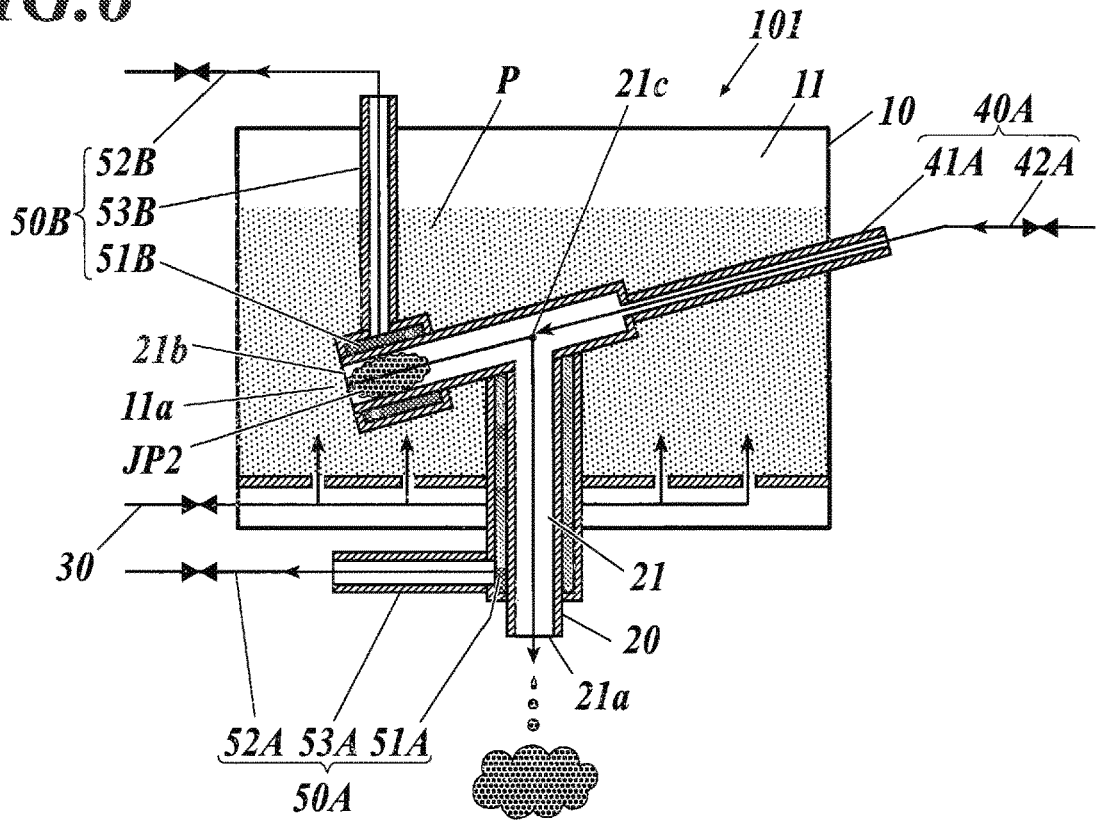
FIG. 6 is a front schematic view of a powder supply device in the second embodiment of the present invention, changing an angle of an inflow port in FIG. 4.
Figure 7:
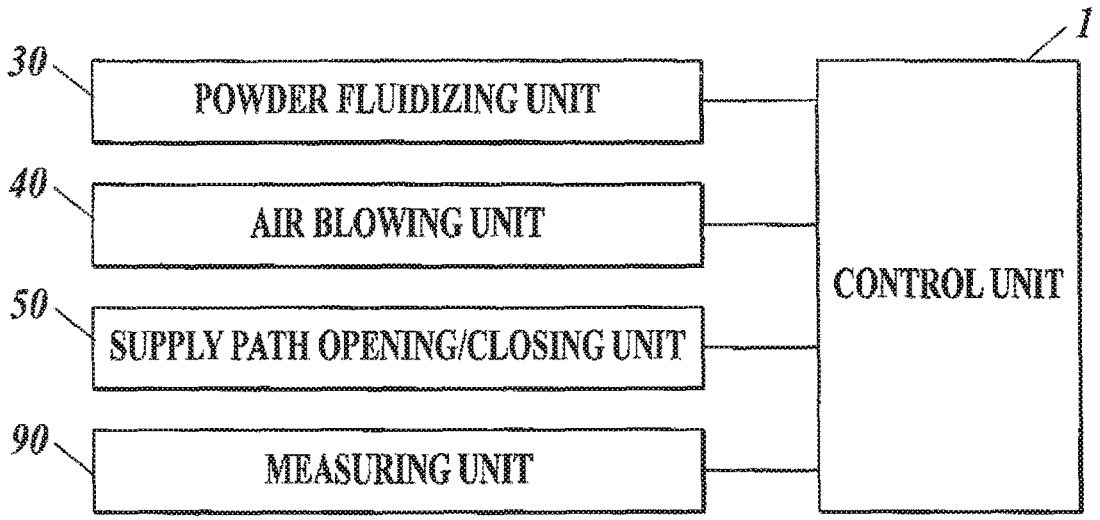
FIG. 7 is a block diagram of a control system of a powder supply device in second and third embodiments of the present invention.

In the configurations shown in FIGS. 4, 5 and 6, the connection angle α of the air blowing tube 41A with respect to the axial direction of the inflow port 21*b* is 180 degrees. In the configurations shown in FIGS. 4 and 5, the powder supply path 21 is a horizontal path from the inflow port 21*b* to a predetermined dimension. In the configuration shown in FIG. 6, the powder supply path 21 is a rising slope path from the inflow port 21*b* to a predetermined dimension. In a case of closing the powder supply path 21 by the aggregated powder JP, when the inflow port 21*b* is directed upward as shown in FIG. 1, the accuracy of stopping the powder supply by the supply path opening/closing unit 50 is worse due to the influence of the powder's own weight. By making the powder supply path 21 from the inflow port 21*b* to an appropriate dimension be a horizontal path as shown in FIGS. 4 and 5 or a rising slope path as shown in FIG. 6, such a bad influence can be reduced and the powder supply can be stopped by the supply path opening/closing unit 50 accurately.

The control contents of the powder supply in the powder supply device 101 in the embodiment will be described later.

[Third Embodiment]

Figure 8:
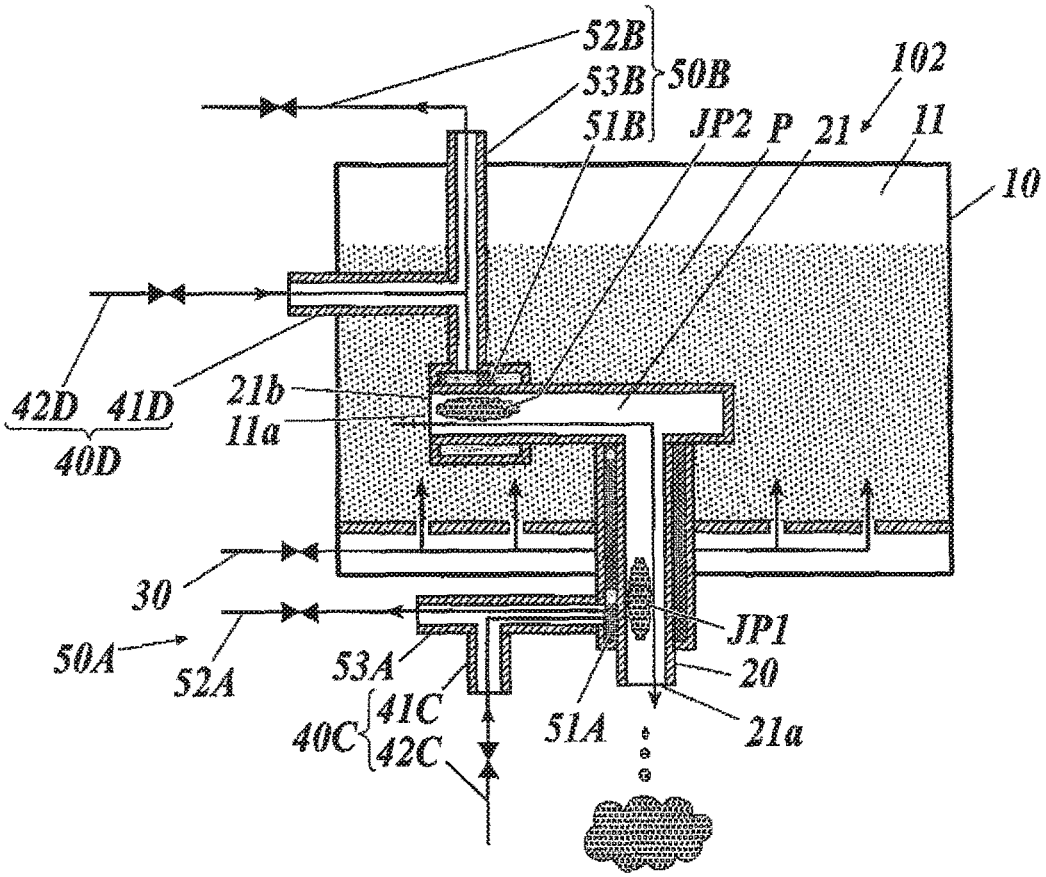
FIG. 8 is a front schematic view of a powder supply device in the third embodiment of the present invention.

Next, the powder supply device in the third embodiment of the present invention will be described. As shown in FIG. 8, the powder supply device 102 in the embodiment has a configuration similar to that of the powder supply device 101 in the second embodiment except that the powder supply device 102 in the third embodiment has the following configuration.

In a third type of air blowing unit 40C, an air blowing tube 41C is connected to the air intake tube 53A. That is, the air intake path of the first type of supply path opening/closing unit 50A and the air blowing path of the third type of air blowing unit 40C are a common path immediately anterior to the powder supply path 21.

In a state in which a constant suction force is applied by the first type of supply path opening/closing unit 50A, by controlling the air blowing amount by the third type of air blowing unit 40C, it is possible to control the size of the aggregated powder JP1, that is, the opening degree of the powder supply path 21. By controlling the air blowing amount in a range of remaining after offset of the suction force by the first type of supply path opening/closing unit 50A, air is blown from inside the powder supply path 21 to the inflow port 21*b* and further to the immediate anterior region 11*a* similarly to the first embodiment, and the powder ejection amount from the ejection port 21*a* can be controlled.

In a fourth type of air blowing unit 40D, an air blowing tube 41D is connected to the air intake tube 53B. That is, the air intake path of the second type of supply path opening/closing unit 50B and the air blowing path of the fourth type of air blowing unit 40D are a common path immediately anterior to the powder supply path 21.

In a state in which a constant suction force is applied by the second type of supply path opening/closing unit 50B, by controlling the air blowing amount by the fourth type of air blowing unit 40D, it is possible to control the size of the aggregated powder JP2, that is, the opening degree of the powder supply path 21. By controlling the air blowing amount in a range remaining after offset of the suction force by the second type of supply path opening/closing unit 50B, air is blown from inside the powder supply path 21 to the inflow port 21*b* and further to the immediate anterior region 11*a* similarly to the first embodiment, and the powder ejection amount from the ejection port 21*a* can be controlled.

One or both of the third type of air blowing unit 40C and the fourth type of air blowing unit 40D are used. The block diagram of a control system of the powder supply device 102 in the embodiment is similar to FIG. 7.

The control contents of powder supply in the powder supply device 102 in the embodiment will be described later.

[Powder Supply Control]

Figure 9:
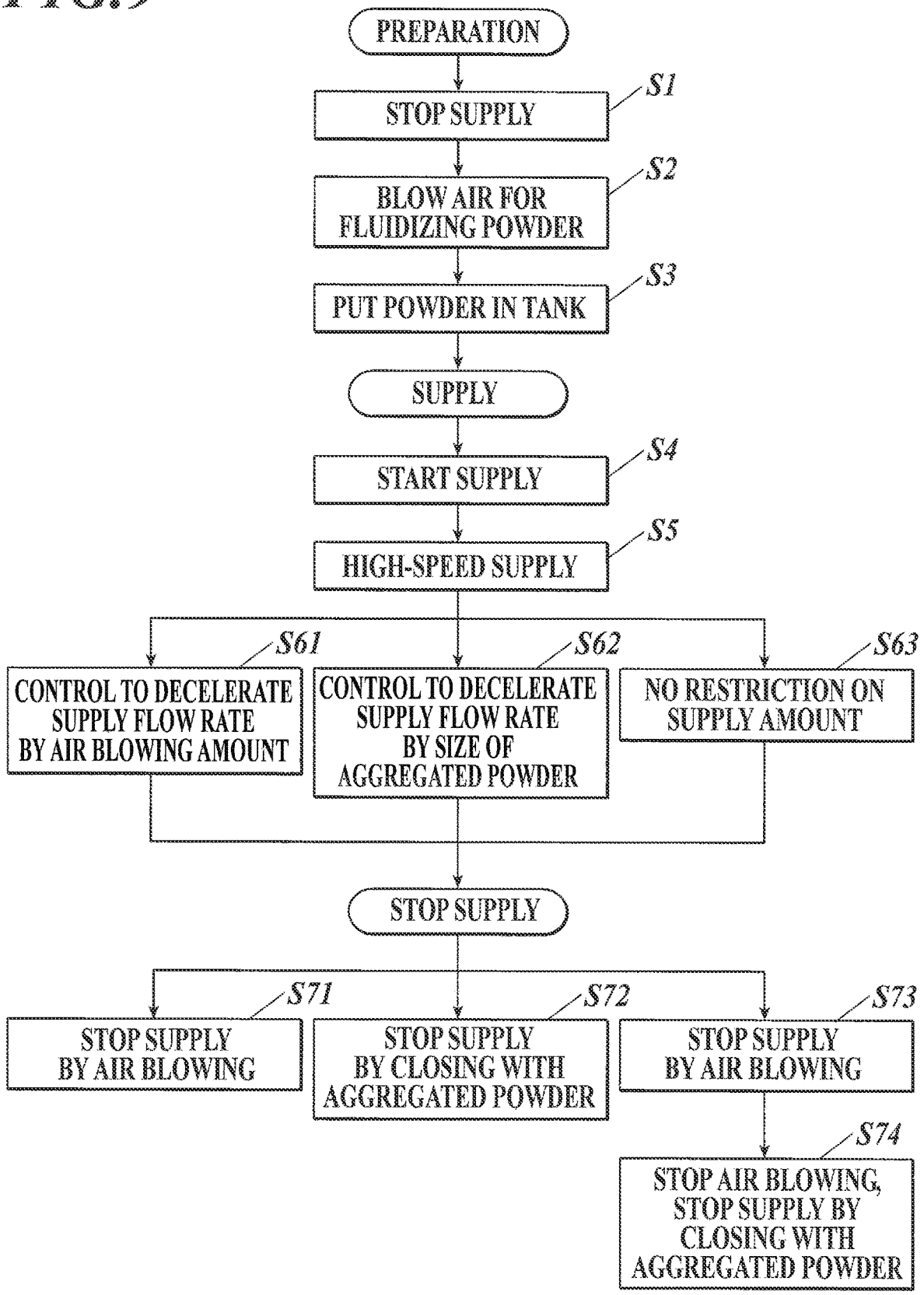
FIG. 9 is a flowchart of powder supply control in the embodiments of the present invention.

Next, the control contents of the powder supply by the above-mentioned powder supply devices 100 to 102 will be described with reference to the flowchart of FIG. 9. In the control unit 1, a target value of the supply amount of the powder P has been already set.

(Preparation Control)

First, the control unit 1 executes preparation control as in the following manner.

In a state of supply stop (step S1), the control unit 1 controls the powder fluidizing unit 30 to blow air for fluidizing the powder P into the tank 10 (step S2), and replenishes the powder P to a predetermined level in the tank 10 (step S3). Here, in the first embodiment, the control unit 1 stops the supply by controlling the air blowing unit 40 to blow the air blowing amount which makes the powder ejection amount from the ejection port 21*a* be zero (The control is also possible in the second and third embodiments). In the second embodiment, the control unit 1 stops the supply by controlling the air blowing amount by the air blowing unit 40 to zero, and at the same time, further controls the supply path opening/closing unit 50 to make the aggregated powder JP. In the third embodiment, the control unit 1 stops the supply by controlling the air blowing amount by the air blowing unit 40 to zero and making the aggregated powder JP with the suction force by the supply path opening/closing unit 50.

(Supply Control)

Next, the control unit 1 executes the supply control as in the following manner.

The control unit 1 starts supply of the powder P (step S4). Here, in the first embodiment, the control unit 1 controls the air blowing unit 40 to decelerate the air blowing amount or make the air blowing amount be zero, and thereby starts the supply. In the second embodiment, the control unit 1 controls air blowing by the air blowing unit 40 at the same time as the control of the supply path opening/closing unit 50 to reduce or eliminate the aggregated powder JP, and thereby starts the supply. In the third embodiment, the control unit 1 controls the air blowing amount by the air blowing unit 40 to reduce or eliminate the aggregated powder JP, and thereby starts the supply.

In the second and third embodiments, the control unit 1 causes the air blowing unit 40 to blow out strong air and blow off the aggregated powder JP, and thereby starts supply at a full supply flow rate at once.

In order to increase the supply speed, the supply is performed at a high supply flow rate for a while from the start of supply (step S5).

Next, the control unit 1 decelerates the powder ejection amount from the ejection port 21*a* for deceleration stop when it is determined that the measurement value of the measuring unit 90 reaches a predetermined threshold lower than the target value (steps S61 and S62).

Step S61 can be performed in any of the first to third embodiments. In step S61, the control unit 1 increases the air blowing amount by the air blowing unit 40, and thereby decelerates the powder ejection amount from the ejection port 21*a*. The powder ejection amount may be decelerated in multiple steps or continuously.

Step S62 can be performed in the second and third embodiments. In step S62, the control unit 1 increases the size of the aggregated powder JP, that is, lowers the opening degree of the powder supply path 21, and thereby decelerates the powder ejection amount from the ejection port 21*a*. Similarly, the powder ejection amount may be decelerated in multiple steps or continuously.

In step S63, the above-mentioned control of decelerating the powder ejection amount is not performed.

(Supply Stop Control)

Next, the control unit 1 executes the supply stop control as in a following manner.

When it is determined that the measurement value of the measuring unit 90 reaches the target value or a predetermined threshold lower than the target value, the control unit 1 stops the supply (steps S71, S72, S73 and S74).

In the first embodiment, the control unit 1 executes step S71. In step S71, the control unit 1 controls the air blowing unit 40 to blow out the air blowing amount to make the powder ejection amount from the ejection port 21*a* be zero, and thereby stops the supply. Step S71 can also be performed in the second and third embodiments.

Step S72 can be performed in the second and third embodiments.

In a case of the second embodiment, in step S72, the control unit 1 controls the supply path opening/closing unit 50 to make the aggregated powder JP, and stops the supply.

In a case of the third embodiment, in step S72, the control unit 1 controls the air blowing amount by the air blowing unit 40 to zero and makes the aggregated powder JP with a suction force by the supply path opening/closing unit 50, and thereby stops the supply.

Furthermore, steps S73 and S74 can be performed in the second and third embodiments.

In a case of the second embodiment, in step S73, the control unit 1 controls the air blowing unit 40 to blow out the air blowing amount to make the powder ejection amount from the ejection port 21*a* be zero, and thereby stops the supply. In step S74, the control unit 1 controls the supply path opening/closing unit 50 to make the aggregated powder JP, and thereby stops the supply. In step S74, the control unit 1 stops air blowing by the air blowing unit 40, starts suction by the supply path opening/closing unit 50 to make the aggregated powder JP at the same time or before the stop of the air blowing, and closes the powder supply path 21, in order to maintain the supply stop state.

In a case of the third embodiment, in step S73, the control unit 1 controls the air blowing unit 40 to blow out the air blowing amount to make the powder ejection amount from the ejection port 21*a* be zero, and thereby stops the supply. In step S74, the control unit 1 stops the air blowing by the air blowing unit 40 to make the aggregated powder JP with a suction force by the supply path opening/closing unit 50, and thereby stops the supply.

The above step S61, S62 or S63 is selected to be executed. Next, step S71, S72 or S73 is selected to be executed and step S74 is executed after step S73 to stop the supply. Then, the processing can return to step S1.

As described above, according to the powder supply device in the embodiments, the powder P stored in the tank 10 is ejected to be supplied from the ejection port 21*a*, the inflow amount is suppressed by controlling the blowing amount of the air blown toward the powder P which is about to flow into the inflow port 21*b* to the powder supply path 21 from the tank 10, and the powder ejection amount from the ejection port 21*a* is controlled. Thus, the supplied powder flow rate can be accurately controlled without depending on the powder flow path cross-sectional area.

Although embodiments of the present invention have been described and illustrated in detail, the disclosed embodiments are made for purposes of illustration and example only and not limitation. The scope of the present invention should be interpreted by terms of the appended claims.

The entire disclosure of Japanese Patent Application No. 2016-245326 filed on Dec. 19, 2016 is incorporated herein by reference in its entirety.

What is claimed is:

1. A powder supply device which ejects a powder stored in a tank from a predetermined ejection port to supply the powder, the powder supply device comprising:

a powder fluidizing unit which blows air into the powder in the tank to fluidize the powder;

a powder supply path forming member which forms a powder supply path in which one end is the ejection port and the other end is an inflow port connected to the tank, wherein the powder in the tank which is fluidized by the powder fluidizing unit flows into the inflow port so as to be ejected from the ejection port through the powder supply path;

an air blower which blows air toward the powder that is about to flow into the inflow port; and a hardware processor, wherein the hardware processor is capable of executing supply flow rate control of controlling a powder ejection amount from the ejection port according to an air blowing amount by the air blower by controlling the air blowing amount, and the air blowing amount by the air blower is increased to reduce or stop a powder ejection.

2. The powder supply device according to claim 1, wherein the air blower is capable of blowing an air blowing amount which makes the powder ejection amount from the ejection port be zero, and the hardware processor is capable of executing supply stop control of stopping powder supply by controlling the air blowing amount by the air blower to make the powder ejection amount from the ejection port be zero after the powder is supplied by the supply flow rate control.

3. The powder supply device according to claim 1, further comprising a supply path opening/closing unit which closes the powder supply path by sucking air from a mixture of the powder and air in the powder supply path through a filter to temporarily aggregate the residual powder, the filter being impermeable to the powder and permeable to air.

4. The powder supply device according to claim 3, wherein the hardware processor is capable of executing supply stop control of stopping powder supply by controlling the supply path opening/closing unit to make an opening degree of the powder supply path be zero after the powder is supplied by the supply flow rate control.

5. The powder supply device according to claim 3, wherein the hardware processor is capable of executing supply stop control of stopping powder supply by controlling the supply path opening/closing unit to make an opening degree of the powder supply path be zero after the powder is supplied by controlling the supply path opening/closing unit to control the opening degree of the powder supply path.

6. The powder supply device according to claim 2, further comprising a measure which measures the powder ejected from the ejection port and inputs a measurement value to the hardware processor, wherein the hardware processor controls a timing of stopping the powder supply based on the measurement value of the measure.

7. The powder supply device according to claim 6, wherein the hardware processor is capable of setting a target value of a supply amount of the powder and executing deceleration stop control of decelerating the powder ejection amount as the measurement value of the measure approaches the target value and stopping the powder supply.

8. The powder supply device according to claim 1, wherein the powder supply path is a horizontal path or a rising slope path from the inflow port to a predetermined dimension.

* * * * *